US007918290B2

(12) United States Patent
Rushton

(10) Patent No.: US 7,918,290 B2
(45) Date of Patent: Apr. 5, 2011

(54) SYSTEMS AND METHODS FOR PROTECTING DRILL BLADES IN HIGH SPEED TURBINE DRILLS

(75) Inventor: Guy J. Rushton, Malmesbury (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 69 days.

(21) Appl. No.: 12/313,463

(22) Filed: Nov. 20, 2008

(65) Prior Publication Data

US 2010/0122850 A1 May 20, 2010

(51) Int. Cl.
*E21B 4/02* (2006.01)

(52) U.S. Cl. ..... 175/107; 416/241 R; 175/296; 415/903

(58) Field of Classification Search ..... 175/57, 175/65, 107; 415/903, 901; 416/241 R
See application file for complete search history.

(56) References Cited

U.S. PATENT DOCUMENTS 2,591,488 A * 4/1952 Yost ..... 175/100
2,865,602 A * 12/1958 Whittle ..... 175/107
3,268,017 A * 8/1966 Yarbrough ..... 175/25
4,475,605 A * 10/1984 Ioanesian et al. ..... 175/107
5,101,916 A * 4/1992 Lesh ..... 175/107
7,308,937 B2 * 12/2007 Radford et al. ..... 166/269
7,686,075 B2 * 3/2010 Stewart et al. ..... 166/106

* cited by examiner

*Primary Examiner* — Kenneth Thompson
*Assistant Examiner* — Sonya Bible
(74) *Attorney, Agent, or Firm* — Jeremy P. Welch; Brigitte L. Echols; Charlotte Rutherford

(57) ABSTRACT

A drilling assembly in an elongated hole including a housing defining an interior with a plurality of motor stages in the interior. Each motor stage has at least one blade with supporting platform surfaces. A casing within the interior surrounds the plurality of motor stages and defines an annular flowpath with the housing. The casing also defines at least one offtake passage adjacent each motor stage. A shielding fluid passes through the annular flowpath and, in turn, the at least one offtake of each motor stage to coat and protect the at least one blade and supporting platform surfaces. A driving fluid passes through the casing for propelling the at least one blade of each motor stage. Preferably, the shielding fluid is at a relatively higher pressure than the driving fluid with a substantially constant ratio maintained between the between the shielding fluid and the driving fluid.

20 Claims, 2 Drawing Sheets

SYSTEMS AND METHODS FOR PROTECTING DRILL BLADES IN HIGH SPEED TURBINE DRILLS

BACKGROUND OF THE DISCLOSURE

1. Field of the Disclosure

The subject disclosure relates to down-hole drilling assemblies, and more particularly to improved protection for the blades of turbine drill components.

2. Background of the Related Art

The use of generating power from a turbine system is well known and widely used in various engineering fields. In oil exploration, drilling is an established method of creating a bore-hole through the earth. Many oil exploration drilling machines are turbine drills powered by a turbine blade system. Impulse type drilling turbines are driven by a fluid at atmospheric pressure, while reaction type drilling turbines are driven by fluid pressurised to above atmospheric pressure, possessing energy which is partly kinetic and partly pressure.

The "Bernoulli principle" of creating differential pressure is used to result in a movement of the body towards the low pressure side of the body. In drilling turbine applications, the Bernoulli principle is used to transfer the hydraulic power of a drilling fluid being pumped through the drilling turbine of stators and rotors into rotational power of a rotor element, which is rigidly attached to a drive shaft system. Ultimately, the drive shaft system is connected to a drilling bit for the explicit purpose of boring through the earth's structure such as rock. The hydraulic fluid is often referred to a drilling mud.

The drilling mud usually has an abrasive component. As the mud is under pressure and potentially travels at high speed, the abrasiveness of the drilling mud erodes the internal components of the drilling turbine. The blades and adjacent support surfaces of the drilling turbine are particularly susceptible to erosion which causes poor efficiency and frequent replacement at great expense. The rate of erosion is related to fluid velocity, drilling fluid density, the shape of the internal components and the material of the internal components. By limiting the fluid velocity to avoid erosion, the speed of the drilling turbine is limited. Thus, the power density is lowered, which affects the length of the drilling tool.

The internal components are often steel of various compositions, for example, carbon steels or stainless steels. These steel materials have certain advantages and inherent disadvantages, the main advantage being that the complex shape of the blade profile is readily cast by various methods. Also, steels of certain chemical composition can be heat treated to enhance the end product characteristics. Stator and rotor elements are typically constructed as a one piece cast/moulded component or made up from several constituent parts, such as rotor blade hubs, stator blade shrouds and blades.

Despite many advances, there are still erosion problems associated with the internal components of turbine drilling due to the abrasive nature of the drilling mud.

SUMMARY OF THE INVENTION

In view of the above, there is a need for an improved drilling turbine with a blade protection mechanism that reduces abrasive wear to increase turbine life, maintains performance, and/or increases power density. Preferably, the improved drilling turbine has reduced abrasion against the turbine blades and supporting platform surfaces.

The present technology is directed to a method for protecting blades in an elongated turbo drilling system including the steps of providing a shielding flow to the elongated turbo drilling system as well as coating blades and supporting platform surfaces of a first stage with a first portion of the shielding flow to form a first layer of fluid thereon. The method also includes the step of driving the blades by applying a second layer of fluid to the blades, wherein the first layer is relatively slower moving than the second layer of fluid and the second layer is maintained substantially away from the blades and supporting platform surfaces by the first layer.

Preferably, the first layer of fluid is at a relatively higher pressure than the second layer. The method may also include the steps of coating blades and supporting platform surfaces of a second stage with a second portion of the shielding flow to form a protective layer of fluid thereon, and driving the blades of the second stage by applying a working layer of fluid to the blades, wherein the protective layer of the second stage is relatively slower moving than the working layer of fluid and the working layer is maintained substantially away from the blades and supporting platform surfaces of the second stage by the protective layer. The shielding flow may be throttled down between the first and second stages.

In another embodiment, the subject technology is directed to a drilling assembly in an elongated hole including a housing defining an interior with a plurality of motor stages in the interior. Each motor stage has at least one blade with supporting platform surfaces. A casing within the interior surrounds the plurality of motor stages and defines an annular flowpath with the housing. The casing also defines at least one offtake passage adjacent each motor stage. A shielding fluid passes through the annular flowpath and, in turn, the at least one offtake of each motor stage to coat and protect the at least one blade and supporting platform surfaces. A driving fluid passes through the casing for propelling the at least one blade of each motor stage.

The shielding fluid and driving fluid are typically drilling mud with the shielding fluid being at a relatively higher pressure than the driving fluid. Preferably, a substantially constant ratio is maintained between the between the shielding fluid and the driving fluid. Throttling elements may be used between each motor stage to maintain the ratio substantially constant.

Each offtake passage may be a stepped back flow opening with respect to the shielding fluid. The casing can further define at least one source hole for providing a portion of the driving fluid into the annular flowpath. The at least one source hole defines an inlet and an upstream outlet, the inlet having a downstream side that is stepped with respect to an opposing upstream side and the downstream side curves upstream.

Still another embodiment of the present technology includes a method for drilling using a turbine assembly in an elongated hole comprising the steps of providing a housing that defines an interior, mounting a plurality of motor stages in the interior, and surrounding the plurality of motor stages with a casing within the interior. Each motor unit has blades. The casing defines an annular flowpath with the housing and at least one offtake passage adjacent each motor stage. The method also includes passing a shielding fluid through the annular flowpath and, in turn, the at least one offtake of each motor stage to coat and protect the blades, and passing a driving fluid through the casing for propelling the blades of each motor stage. The method may further pressurize the shielding fluid to a relatively higher pressure than the driving fluid, and provide at least one throttling element between each motor stage. Each at least one offtake passage may be a stepped back flow opening with respect to the shielding fluid.

It should be appreciated that the present invention can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the following drawings.

DETAILED DESCRIPTION OF PREFERRED EMBODIMENTS

Figure 1:
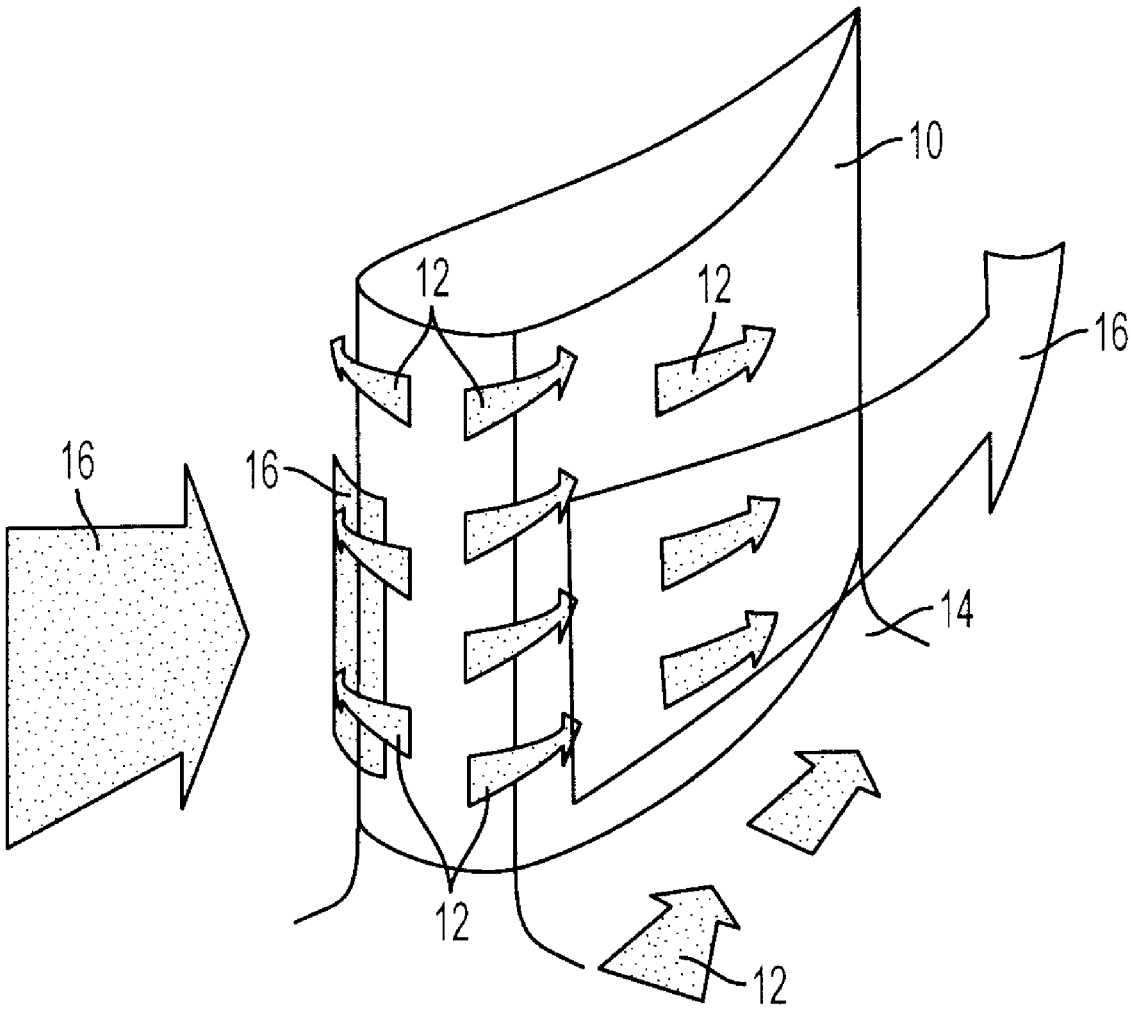
FIG. 1 is an isolated perspective view of a turbine blade having a protective layer of fluid in accordance with the subject technology.

The present disclosure overcomes many of the prior art problems associated with down-hole drilling assemblies. The advantages, and other features of the system disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

All relative descriptions herein such as left, right, up, and down are with reference to the Figures, and not meant in a limiting sense. Additionally, for clarity common items, such as linkages, have not been included in the Figures as would be appreciated by those of ordinary skill in the pertinent art. Unless otherwise specified, the illustrated embodiments can be understood as providing exemplary features of varying detail of certain embodiments, and therefore, unless otherwise specified, features, components, modules, elements, and/or aspects of the illustrations can be otherwise combined, interconnected, sequenced, separated, interchanged, positioned, and/or rearranged without materially departing from the disclosed systems or methods. Additionally, the shapes and sizes of components are also exemplary and unless otherwise specified, can be altered without materially affecting or limiting the disclosed technology.

Referring now to FIG. 1, an isolated perspective view of a turbine blade 10 having a protective flow or layer 12 of fluid, as denoted by small arrows, is shown. The turbine blade 10 extends from a support 14, which is also at least partially covered by the protective layer 12. The turbine blade 10 is driven by a driving or main flow 16, as denoted by large arrows. However, the fast moving main flow 16 is maintained away from the turbine blade 10 and support 14 by the protective layer 12, which moves more slowly. As a result, the rate of erosion of the surfaces coated by the protective layer 12 is reduced.

Without being limited to any particular concept, the surface of the turbine blade is coated by the protective layer 12 because the protective layer 12 is at a relatively higher pressure than the main flow 16. By directing the protective layer 12 onto a surface at a relatively higher pressure, the main flow 16 is maintained away from such surface. The layout of the feed holes (not shown) for the protective layer 12 is adapted and configured depending upon the size and shape of the surface to be coated. Consequently, once areas of high erosion are determined, holes and/or slots can be provided to coat these areas with the protective layer 12.

The protective layer 12 and main flow 16 may both be drilling mud. In one embodiment, the protective layer 12 is separately pressurized by a pump (not shown). In another embodiment, the protective layer 12 may be a different composition than the main flow 16. Typically, mixing between the protective layer 12 and the main flow 16 would occur.

Figure 2:
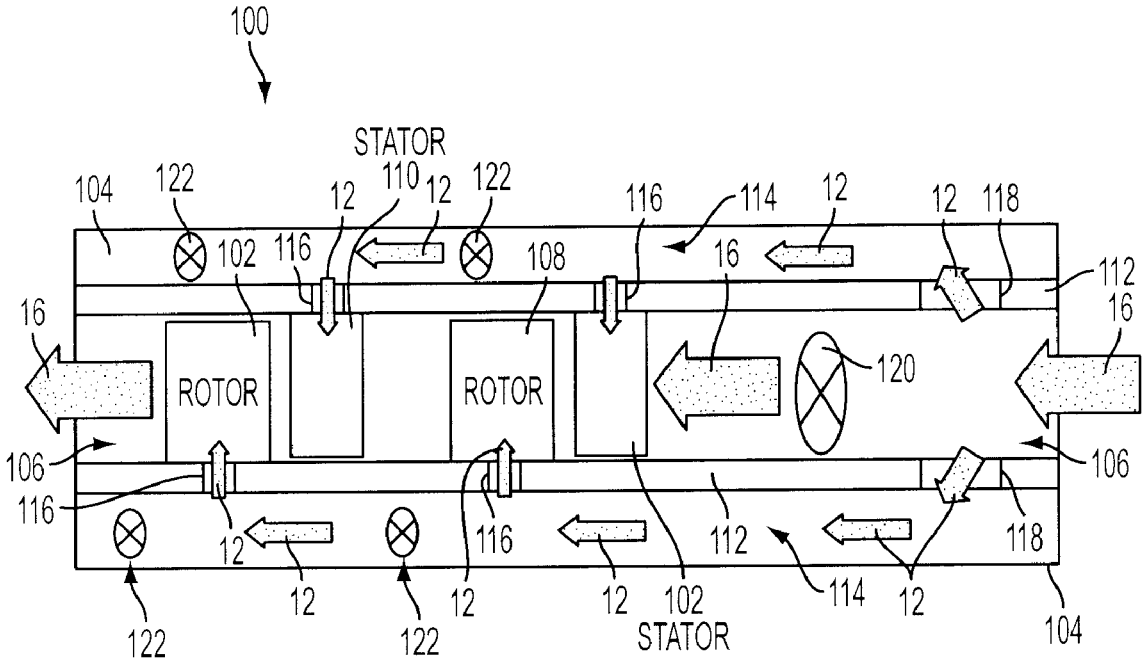
FIG. 2 is a somewhat schematic view of a down-hole system in accordance with the subject technology.

Referring additionally to FIG. 2, a somewhat schematic view of a down-hole drilling system 100 in accordance with the subject technology is shown. The system 100 would be used in an elongated hole (not shown) to further add to the length of the hole by drilling. The system 100 includes a plurality of motor stages 102, each motor stage 102 having a plurality of blades 10 with supporting platform surfaces 14. The protective flow 12 and the main flow 16 pass through the system 100 such that the blades 10, supporting platform surfaces 14 and other surfaces may be desirably coated with the protective flow 12 as described above. The system 100 may include as many motor stages 102 as necessary for the system 100 to meet desired specifications as is well known to those of ordinary skill in the pertinent art.

The system 100 includes a housing 104 defining an interior 106. The plurality of motor stages 102 mount in the interior 106. Each motor stage 102 has a rotor 108 and a stator 110. A casing 112 within the interior 106 surrounds the plurality of motor stages 102 to largely keep the protective flow 12 and the main flow 16 separated. As the protective flow 12 and the main flow 16 would normally be similar if not the same composition, mixing within the system 100 is expected.

The casing 112 defines an annular flowpath 114 with the housing 104 for the protective layer 12. A plurality of offtake passages 116 provide flow of the protective layer 12 into the interior 106. A single offtake passage 116 is shown adjacent each rotor 108 and stator 110 but, as noted above, a plurality of holes and slots may be necessary to accomplish the desired coating of the surfaces to be protected.

The main flow 16 passes centrally through the casing 112 to provide the driving force for the motor stages 102. As shown, the protective flow 12 is actually a borrowed portion of the main flow 16 that passes through a plurality of source holes 118 formed in the casing 112. Thus, on the right side of FIG. 2, the protective flow 12 and the main flow 16 are at similar pressure. In order to create the desired pressure differential, a main throttling element 120 may be placed in the flowpath of the main flow 16. A suitable throttling element 120, as understood by one skilled in the art, may take numerous forms including but not limited to known throttling valves, choke valves or restrictors. The main throttling element may be fixed in nature or may be variable.

In another embodiment, natural loss of pressure as the main flow 16 performs work in the motor stages 102 may result in all or most of the necessary pressure differential between the protective layer 12 and the main flow 16. It is envisioned that a combination of natural pressure loss and throttling elements may be used in various combinations to accomplish the desired pressure differential. For example, as the protective flow 12 and main flow 16 pass through multiple motor stages 102, the pressure of the protective flow 12 may need to be further reduced by additional throttling elements 122. As a result, a constant ratio may be maintained between the protective flow 12 and the main flow 16.

The shape of the annular flowpath 114 may pressurize the flow of the protective layer 12 and/or the main flow 16. For example, the annular flowpath 114 may narrow in the area of the offtake passages 116 to increase the pressure of the protective layer 12 passing therethrough. Alternatively, the flow of the protective layer 12 may be pressurized by a pump or other manner.

Figure 3:
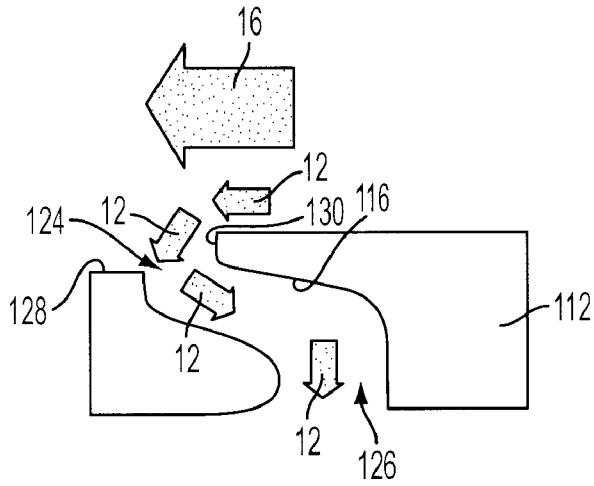
FIG. 3 is a cross-sectional view of an exemplary offtake in accordance with the subject technology.

Referring now to FIG. 3, a cross-sectional view of an exemplary source hole 118 in accordance with the subject technology. Preferably, the offtake passages 116 and source holes 118 are designed to prevent over-large particles from being in the protective flow 12 against the protected surfaces. Additionally, an over-large particle may become lodged in an offtake passage 116 or source hole 118 and block flow.

The source hole 118 defines an inlet 124 and an upstream outlet 126. The inlet 124 has a downstream side 128 that is stepped with respect to the upstream side 130. Accordingly, larger particles with relatively larger momentum in the main flow 16 will tend to pass by the inlet 124 rather than passing into the source hole 118. Further, the downstream side 128 curves upstream, which may help to prevent large particles from entering and reduce the speed of the protective flow 12.

While the invention has been described with respect to preferred embodiments, those skilled in the art will readily appreciate that various changes and/or modifications can be made to the invention without departing from the spirit or scope of the invention as defined by the appended claims. For example, each claim may depend from any or all claims in a multiple dependent manner even though such has not been originally claimed.

What is claimed is:

1. A method for protecting blades in an elongated turbo drilling system comprising the steps of:

a) providing a shielding flow to the elongated turbo drilling system;

b) coating blades and supporting platform surfaces of a first stage with a first portion of the shielding flow to form a first layer of fluid thereon; and c) driving the blades by applying a second layer of fluid to the blades, wherein the first layer is relatively slower moving than the second layer of fluid and the second layer is maintained substantially away from the blades and supporting platform surfaces by the first layer.

2. A method as recited in claim 1, wherein the first layer of fluid is at a relatively higher pressure than the second layer.

3. A method as recited in claim 1, further comprising the steps of:

coating blades and supporting platform surfaces of a second stage with a second portion of the shielding flow to form a protective layer of fluid thereon; and driving the blades of the second stage by applying a working layer of fluid to the blades, wherein the protective layer of the second stage is relatively slower moving than the working layer of fluid and the working layer is maintained substantially away from the blades and supporting platform surfaces of the second stage by the protective layer.

4. A method as recited in claim 3, further comprising the step of throttling down the shielding flow between the first and second stages.

5. A method as recited in claim 1, wherein the shielding flow passes axially along the elongated turbo drilling system and passes through at least one stepped back flow offtake to coat the blades and supporting platform surfaces of the first stage.

6. A method as recited in claim 1, wherein the shielding flow and second layer are drilling mud.

7. A drilling assembly in an elongated hole comprising:

a housing defining an interior;

a plurality of motor stages in the interior, each motor stage having at least one blade with supporting platform surfaces;

a casing within the interior and surrounding the plurality of motor stages, the casing defining an annular flowpath with the housing and at least one offtake passage adjacent each motor stage;

a shielding fluid passing through the annular flowpath and, in turn, the at least one offtake of each motor stage to coat and protect the at least one blade and supporting platform surfaces; and a driving fluid passing through the casing for propelling the at least one blade of each motor stage.

8. A drilling assembly as recited in claim 7, wherein the shielding fluid and driving fluid are drilling mud and the casing is generally tubular.

9. A drilling assembly as recited in claim 7, wherein the shielding fluid is at a relatively higher pressure than the driving fluid and a substantially constant ratio is maintained between the between the shielding fluid and the driving fluid.

10. A drilling assembly as recited in claim 7, wherein the shielding fluid is relatively slower moving than the driving fluid and the driving fluid is maintained substantially away from the blades and supporting platform surfaces.

11. A drilling assembly as recited in claim 7, further comprising at least one throttling element between each motor stage.

12. A drilling assembly as recited in claim 7, wherein the shielding flow passes axially along the annular flowpath, and as the driving fluid performs work in the motor stages, a pressure of the driving, fluid is reduced.

13. A drilling assembly as recited in claim 7, wherein each at least one offtake passage is a stepped back flow opening with respect to the shielding fluid.

14. A drilling assembly as recited in claim 7, wherein the casing further defines at least one source hole for providing a portion of the driving fluid into the annular flowpath.

15. A drilling assembly as recited in claim 14, wherein the at least one source hole defines an inlet and an upstream outlet, the inlet having a downstream side that is stepped with respect to an opposing upstream side.

16. A drilling assembly as recited in claim 15, wherein the downstream side curves upstream.

17. A method for drilling using a turbine assembly in an elongated hole comprising the steps of:

providing a housing that defines an interior;

mounting a plurality of motor stages in the interior, each motor unit having at least one blade;

surrounding the plurality of motor stages with a casing within the interior, wherein the casing defines an annular flowpath with the housing and at least one offtake passage adjacent each motor stage;

passing a shielding fluid through the annular flowpath and, in turn, the at least one offtake of each motor stage to coat and protect the at least one blade; and passing a driving fluid through the casing for propelling the at least one blade of each motor stage.

18. A method as recited in claim 17, further comprising the steps of:

maintaining the shielding fluid at a relatively higher pressure than the driving fluid; and providing at least one throttling element between each motor stage.

19. A method as recited in claim 17, wherein each at least one offtake passage is a stepped back flow opening with respect to the shielding fluid.

20. A method as recited in claim 17, further comprising the steps of:

supporting the at least one blade of each motor stage with a platform surface; and passing the shielding fluid onto the platform surfaces to coat and protect the platform surfaces.

* * * * *